United States Patent [19]

Sexsmith et al.

[11] 4,386,008

[45] May 31, 1983

[54] CORROSION PROTECTION PACKAGE

[75] Inventors: David R. Sexsmith, Teaneck; Bruce L. Libutti, Dover, both of N.J.

[73] Assignee: Drew Chemical Corporation, Boonton, N.J.

[21] Appl. No.: 288,153

[22] Filed: Jul. 29, 1981

[51] Int. Cl.[3] ..... C09K 3/00

[52] U.S. Cl. ..... 252/389 R; 422/14; 150/1; 55/39; 206/0.5

[58] Field of Search ..... 426/415; 206/.5; 422/16, 14, 15, 17; 55/18, 19, 39, 389; 252/175, 176, 393, 90, 178, 387, 389 R, 391; 210/750, 757, 198.1, 206; 150/1

[56] References Cited

U.S. PATENT DOCUMENTS

| | | | |
|---|---|---|---|
| 4,026,664 | 5/1977 | Noack | 252/389 |
| 4,220,528 | 9/1980 | Matsumoto et al. | 422/16 |
| 4,277,366 | 7/1981 | Mago | 422/16 |

OTHER PUBLICATIONS

Disappearing Dye Pouch-Modern Packaging, Oct. 1958, p. 109.

Modern Packaging Encyclopedia, Jul. 1971, vol. 44, No. 7A, p. 139.

*Primary Examiner*—Bernard Nozick

[57] ABSTRACT

A water disintegratable package which includes a solid water soluble salt of hydrazine whereby the package can be added to water to effect disintegration of the package to release the hydrazine salt for solubilization in the water to thereby provide for corrosion protection in aqueous systems.

14 Claims, No Drawings

CORROSION PROTECTION PACKAGE

This invention relates to corrosion protection, and more particularly to inhibiting corrosion in aqueous systems.

It is known in the art to employ hydrazine compounds to retard the corrosion of metal surfaces in various aqueous systems, such as in water and steam apparatus employed as boilers, hot water heating systems, water cooling systems, and the like.

It is generally believed that the hydrazine compound accomplishes such corrosion inhibition by removal of oxygen from gases and liquids, which retards the corrosion of metal surfaces. In some cases, the hydrazine compounds are used in conjunction with a catalyst to facilitate the oxygen removal in corrosive environments.

Such hydrazine compounds are generally employed in liquid form, and in such form, they present a possible occupational hazard to workers who are required to handle the hydrazine.

In accordance with one aspect of the present invention, there is provided an article useful for corrosion protection in aqueous systems which is comprised of a water disintegratable package which includes at least one solid water soluble salt of hydrazine therein, whereby the package can be added to water to effect disintegration of the package to thereby release the hydrazine salt, which is dissolved in the water to provide corrosion protection. In this manner, there is minimal occupational exposure to the hydrazine when utilizing same for corrosion inhibition in aqueous systems.

In accordance with another aspect of the invention, there is provided a process for protecting aqueous systems against corrosion wherein at least one water disintegratable package which includes a solid water soluble salt of hydrazine is added to the aqueous system whereby the water disintegrates the package to provide contact with the salt and water to dissolve the salt.

The hydrazine salt included in the package may be catalyzed with a suitable catalytic or accelerating agent of a type known in the art, or the hydrazine salt may be used without a catalyst.

In accordance with the present invention, the hydrazine salt must be in solid form, and must be soluble in water. As representative examples of suitable salts, which may be used alone or in combination with each other, there may be mentioned dihydrazine sulfate, monohydrazine sulfate, hydrazine nitrate, and hydrazine hydrochloride. In general, the hydrazine salt should have a solubility in water of at least 0.5 g/liter.

As hereinabove noted, the hydrazine salt may be used alone, or in accordance with a preferred embodiment, such hydrazine salts may be catalyzed with a catalyst or accelerator of a type known in the art which facilitates oxygen removal or scavenging in fluidic corrosive environments.

Thus, for example, the solid hydrazine salt may be catalyzed with a solid water soluble quinone, which quinone may be employed in its hydroxyl form. As representative examples of suitable quinones, there may be mentioned: para-quinones, para-hydroquinones, para-naphthoquinones, para-anthraquinones, and the like, as well as their substituted derivatives.

Alternatively, as known in the art, the hydrazine may be catalyzed with a solid water soluble organometallic complex which is a reaction product of an inorganic salt of cobalt, manganese or copper with at least one organic ligand, which may be an unsubstituted and/or inertly substituted amino derivative of a carboxylic acid or salt thereof, as described in U.S. Pat. No. 4,022,711 or an organic ligand which is one or more of unsubstituted and inertly substituted (a) ortho-aminohydroxyaromatics, as described in U.S. Pat. No. 4,026,664.

The hydrazine may be catalyzed with a mixture of a quinone and an organometallic complex.

The selection of a suitable catalyst, if used, is deemed to be within the scope of those skilled in the art from the teachings herein As hereinabove noted, the catalyzed or uncatalyzed hydrazine salt is placed in a package which is water disintegratable, i.e., upon placing the package in the water, the package is disintegrated and permits contact between the water and the hydrazine salt so that the hydrazine salt may become dissolved in the water, alone, or in combination with the catalyst or accelerator. The package is formed from a material which is disintegrated upon prolonged contact with water, and preferably, such package material is water soluble so as to prevent any adverse effects to the system from the presence of non-soluble solids therein. Thus, for example, the package may be formed from polyvinyl alcohol or polyethylene oxide, with polyvinyl alcohol being preferred. As should be apparent, the package could be a composite of material; e.g., paper reinforced polyvinyl alcohol.

The package may be in any one of a wide variety of forms, such as a sealed bag, a capsule, or a sealed bag inside a zip-lock pouch. The package would typically have a net weight of 25 grams to one pound.

The package is preferably in the form of a bag, although, it is to be understood that other forms could also be employed. It is also to be understood that in some cases it may be preferred to include one or more of the hydrazine packages in another package or container in order to protect the hydrazine package from damp atmospheres which may adversely affect the package.

The amount of hydrazine present in the package will vary upon the expected use thereof, and the hydrazine requirements for a particular system. In accordance with a preferred embodiment, the amount of hydrazine present in the package is an amount which would be effective for providing a unit dosage for a particular system. It is to be understood, however, that the package could contain less than such unit dosage, in which case, more than one package would be added to the system at any one time.

In using the hydrazine package in accordance with the invention, such package or packages are added to the aqueous system in an effective corrosion inhibiting amount, with such amount generally being an amount to provide at least the stoichiometric amount of hydrazine salt in the system based on the amount of dissolved oxygen therein. In most cases, the package is employed so as to provide from 0.001 to 1000 ppm, and preferably 0.01 to 400 ppm of hydrazine in the system, prior to reaction with dissolved oxygen.

The hydrazine package is particularly suitable for corrosion protection in boilers and hot water heating systems. In such systems, one or more of such hydrazine packages is preferably added to the feed water, as required; e.g., by addition to the feed water tank. In such systems, the package is generally added to provide from 0.01 to 0.1 ppm of the hydrazine compound in the feedwater.

The present invention will be further described with respect to the following example; however, the scope of the invention is not to be limited thereby:

EXAMPLE

A sealed polyvinyl alcohol bag is filled with dihydrazine sulfate catalyzed with 0.2%, by weight, of hydroquinone to provide a net weight of 100 grams.

The bags were placed in a high humidity atmosphere for a period of two weeks and retained their integrity.

Prior to filling, 1.75 grams of polyvinyl bag material was stirred into 250 ml of water and the bag dissolved in the water, thereby indicating that the bag is both stable to humidity and soluble in water.

The present invention is particularly advantageous in that it is possible to obtain effective corrosion protection without the use of the liquid hydrazine normally used in the art, while at the same time facilitating the handling of the corrosion inhibitor and minimizing the risk of occupational exposure to hydrazine.

Numerous modifications and variations of the present invention are possible in light of the above teachings and, therefore, within the scope of the appended claims, the invention may be practised otherwise than as particularly described.

We claim:

1. An article useful for corrosion protection in aqueous systems, comprising:

a water disintegratable package;

said water disintegratable package containing at least one solid water soluble salt of hydrazine and at least one solid water soluble hydrazine catalyst which is selected from the group consisting of (a) quinones, and (b) an organometallic complex which is a reaction product of a metal selected from the group consisting of cobalt, manganese and copper and an organic ligand selected from the group consisting of (i) unsubstituted and inertly substituted amino derivatives of carboxylic acids and carboxylic acid salts, and (ii) substituted and inertly substituted ortho-aminohydroxyaromatics, whereby the package can be added to water to effect disintegration of the package and dissolution of the hydrazine salt and hydrazine catalyst in water.

2. The article of claim 1 wherein the package is comprised of a member selected from the groups consisting of polyvinyl alcohol and polyethylene oxide.

3. The article of claim 1 wherein the hydrazine catalyst is a quinone.

4. The article of claim 3 wherein said member is polyvinyl alcohol.

5. The article of claim 3 wherein said hydrazine salt is selected from the group consisting of dihydrazine sulfate, monohydrazine sulfate, hydrazine nitrate and hydrazine hydrochloride.

6. The article of claim 5 wherein said hydrazine salt is dihydrazine sulfate.

7. The article of claim 6 wherein the quinone is hydroquinone.

8. The article of claim 3 wherein the hydrazine salt is present in the package in an amount to provide from 0.001 to 1000 ppm of hydrazine in the aqueous system.

9. A process for inhibiting corrosion in an aqueous system, comprising:

adding to an aqueous system at least one water disintegratable package containing at least one solid water soluble salt of hydrazine within said at least one package, said at least one package being added to the aqueous system to provide a corrosion inhibiting amount of the hydrazine salt dissolved in the aqueous system.

10. The process of claim 9 wherein the package is comprised of a member selected from the groups consisting of polyvinyl alcohol and polyethylene oxide.

11. The process of claim 10 wherein said member is polyvinyl alcohol.

12. The process of claim 9 wherein said hydrazine salt is selected from the group consisting of dihydrazine sulfate, monohydrazine sulfate, hydrazine nitrate and hydrazine hydrochloride.

13. The process of claim 9 wherein the hydrazine salt is a catalyzed hydrazine salt.

14. The process of claim 9 wherein the package is a bag comprised of polyvinyl alcohol and the hydrazine salt is dihydrazine sulfate catalyzed with hydroquinone.

* * * * *